United States Patent [19]

Broman

[11] 4,067,503

[45] Jan. 10, 1978

[54] METHOD OF GRINDING IN A MILL

[76] Inventor: John Samuel Broman, Bergslagsvagen 12, S-777 00 Smedjebacken, Sweden

[21] Appl. No.: 675,844

[22] Filed: Apr. 12, 1976

[51] Int. Cl.[2] ..... B02C 15/00

[52] U.S. Cl. ..... 241/30; 241/117

[58] Field of Search ..... 241/30, 110, 114, 117, 241/118, 120

[56] References Cited

U.S. PATENT DOCUMENTS

| | | | |
|---|---|---|---|
| 112,213 | 2/1871 | Brady | 241/114 |
| 3,357,648 | 12/1967 | Ronceray | 241/110 |

*Primary Examiner*—Granville Y. Custer, Jr.

*Attorney, Agent, or Firm*—Pollock, Vande Sande & Priddy

[57] ABSTRACT

The invention concerns a method of influencing the degree of grinding of material which is fed into the peripheral portion of the grinding chamber of a mill whose inclined and upwardly-divergent open bowl or plate-shaped grinding chamber has a central outlet for ground material, said mill having a heavily inclined rotary shaft and at least one cooperating roller in the grinding chamber. The degree of grinding, which corresponds to the retention time of the material in the grinding chamber, is controlled by adapting the rpm of the mill and the incline of the rotary shaft, so that material in the section of the grinding chamber most inclined toward the horizontal plane slides downward toward the central outlet in steps corresponding to the desired degree of grinding.

1 Claim, 3 Drawing Figures

METHOD OF GRINDING IN A MILL

The present invention relates to the grinding of rock and the like in mills.

The most prevalent kind of grinding mill existing today is the drum mill in which grinding media consisting of balls, rods or pebbles work material fed into the mill while a grinding drum is rotated.

The working procedure in such a mill is probability based and provides a random result. Furthermore, an unjustifiably large amount of energy is required in relation to the intended result. The reason for this is that the rolling movement of the grinding balls which should dominate the grinding process constitutes merely a minor portion of the movement which takes place in the grinding chamber. Due to the accumulation of grinding balls, rods or pebbles and material on each other in different layers, rolling, which would be most natural, is prevented. This results in wear grinding between surfaces having oppositely directed movements. Thus, the grinding product will contain, inter alia extremely fine particles worn off the grinding material and oversized particles resulting from forced passage of the material. Said forced passage is resorted to in order to limit the amount of exceedingly fine particles.

Both of the aforementioned particle types cause difficulties in subsequent procedures, especially with respect to mineral recovery. The coarse particles are not sufficiently pure and do not always accompany the mineral concentrate to which said particles actually belong. If they accompany the concentrate, they may reduce the grade of valuable components. Furthermore, the exceedingly fine particles cannot be collected in the apparatus. Rather, they are carried in waste water to tailing dams or natural receptacles, where they cause environmental problems.

The object of the present invention is to reduce these difficulties by means of reducing energy consumption, limiting the production of exceedingly fine particles as well as insufficiently ground particles and facilitating a smooth adaptation of the grinding work to the variations in grinding resistance and grain size existing in incoming material.

The invention relates to a method of influencing the grinding degree of material fed into the peripheral portion of the grinding chamber of a mill whose inclined and upwardly-divergent open bowl- or plate-shaped grinding chamber has a central outlet for ground material, said mill having a heavily inclined rotary shaft and at least one cooperating roller in the grinding chamber.

According to the invention, the period of time in which the material is present in the grinding chamber is controlled by adapting the rpm of the mill and the incline of the rotary shaft, so that material in the section of the grinding chamber most inclined toward the horizontal plane slides downward toward the central outlet in steps corresponding to the desired degree of grinding.

Figure 1:
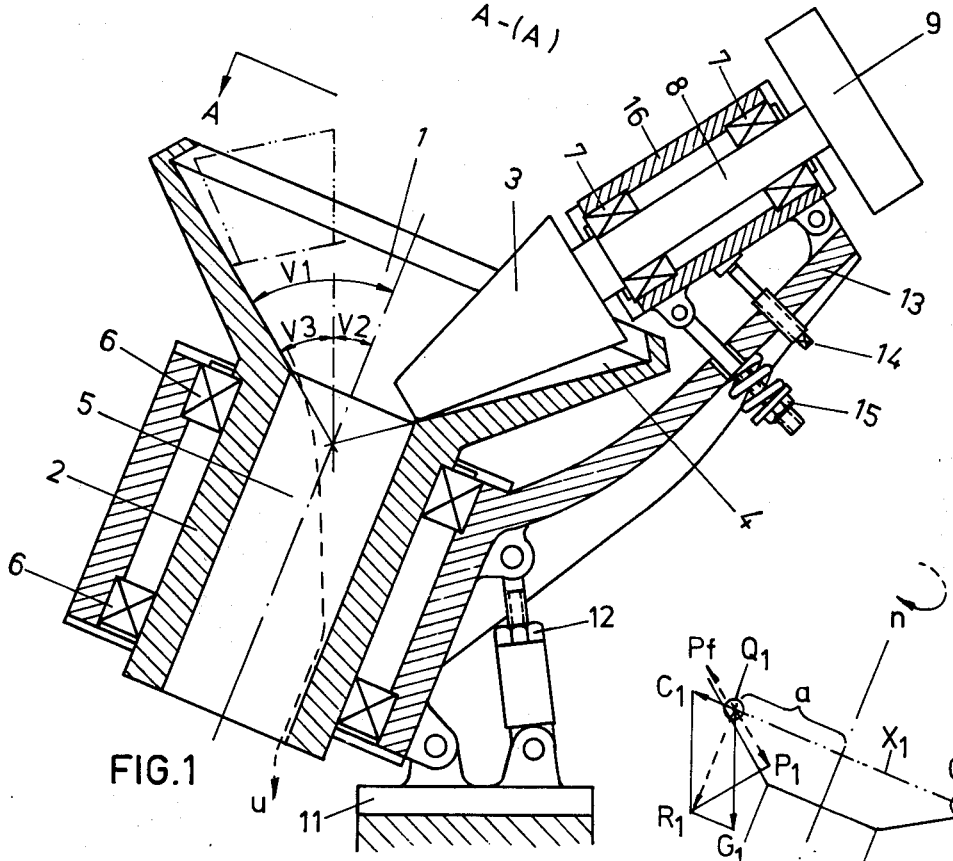

A mill for carrying out the method according to the present invention is described in more detail below. Reference is made to the enclosed drawings in which FIG. 1 is a side view in partial cross-section of a mill according to the invention, said mill being in operating position.

Figure 2:
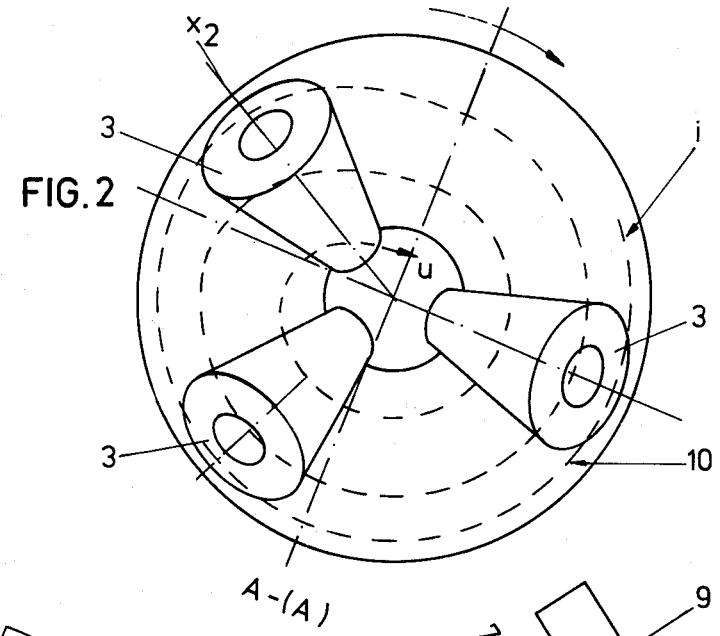

FIG. 2 is a plan view of the grinding chamber, showing the path taken by material fed into the mill.

Figure 3:
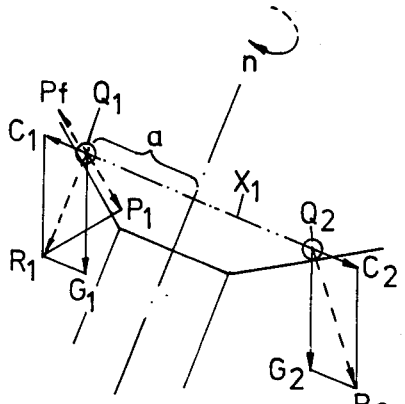

FIG. 3 discloses how various forces influence exposed material particles in a certain section of the grinding chamber.

The main portion of the mill consists of a grinding chamber 1 in the form of a truncated conical casing, the base of the cone being located above its tip, and an inclined, hollow shaft 2 which forms an angle $V_2$ with the vertical plane. Said angle can be substantially the same as or smaller than half of the conical angle $V_1$ of the grinding chamber. The incline of the shaft is adjustable in the following manner. The mill head frame 13 is pivotally supported on the ground plate 11. By lengthening the adjustment device 12 pivoted on ground plate 11 and acting on mill head frame 13, the angle $V_2$ can be increased or decreased. By decreasing the value of angle $V_2$, sliding movement of the material along the surface of the casing toward outlet 5 is decreased, i.e., retention of the material in the grinding chamber is prolonged, resulting in a higher degree of grinding. Increase in the value of angle $V_2$ will have the opposite effect.

One or a plurality of conical grinding rollers 3 cooperate with the conical grinding chamber 1, said grinding rollers 3 being controlled in such a manner that the distance between them and the cone casing can easily be adjusted to a degree suitable for required grinding without allowing the alteration of the incline of the mill shaft 2 to have an effect on said adjustment. As protection against damage, a preloaded safety device 15 holds the housing 16 against adjusting bolt 14 but allows the grinding rollers to move out of normal position in the event that anything out of the ordinary should occur.

Necessary drive power is supplied to the mill by the conical grinding rollers 3. The rpm of the mill can be adjusted. The conical grinding rollers 3 form a wedge-shaped opening 4 with the cone casing 1 which widens towards its base. The grinding rollers 3 can be divided up into several shorter units, the collective length of which more or less corresponds to the length of the cone casing 1.

The grinding rollers 3 can be divided up and arranged in the grinding chamber in such a manner that control of supplied material through the grinding chamber is expediated. If such a grinding roller is placed in the upper area in which the cone mantel is situated, e.g., as disclosed by $X_2$ in FIG. 2, the downward and inward sliding movement of the particles can be interrupted and their movement towards the outlet 5 can be prolonged. If the opening 4 is wedge-shaped as shown in the drawing, a grading effect on the grinding material is obtained, in that particles which are smaller than the opening in each respective section pass through the same and come closer to the outlet 5 while the fall of coarser particles is impeded, said coarser particles being subjected to continued grinding.

Other accompanying details according to the drawing are bearings 6 and 7 for the grinding cone 1 and the grinding rollers 3 with the shaft 8 and a drive arrangement 9 for the grinding rollers 3 with the shaft 8.

In FIG. 2, the path of material supplied at point *i* through the grinding zone and the hollow shaft 2 to feed outlet *u* is shown in principle at 10.

FIG. 3 discloses, inter alia how different forces influence exposed material particles in a certain section of the grinding chamber. A particle $Q_1$ which for example, is situated at a distance *a* from the rotary shaft and moves along the inclined rotation plane $X_1$ is influenced by gravity $G_1$ and by centrifugal force $C_1$ which is dependent on rpm *n*. The resultants of these forces $G_1$ and $C_1$ provide a force $P_1$, which acts in a direction towards the outlet, and a frictional force Pf which counteracts a movement in the direction of $P_1$. These forces balance each other for a certain value of the incline angle $V_3$, but if the angle $V_3$ is reduced sufficiently the particles slide under the influence of the dominating force $P_1$ downward along the cone casing during coexisting rotation until a section of slighter inclination is reached. The particles will be held there by friction during passage of the lower position of the chamber until it reaches a position in a higher section where the force of gravity, as a consequence of the inclined position, exceeds the frictional and centrifugal forces, whereupon another slide down along the cone casing starts, and so on. It will be understood that the real movement of a particle in the upper section of the chamber is a combination of (a) rotation with the chamber rpm, and (b) sliding movement on the chamber surface from a large to a smaller diameter, resulting in the spiral path illustrated in FIG. 2.

The sliding movement along the casing surface thus becomes greater the next time it reaches the upper portion of the rotation plane of. The result, as can be seen, is a gradually increased movement towards the feed outlet.

From the above it can be seen that the movement of the material through the grinding zone is prolonged if the incline of shaft 2, i.e., the angle $V_3$, is increased. The same effect can be obtained by means of an increase in rpm *n*, which provides a greater value for the centrifugal force $C_1$ in FIG. 3.

The incline of the shaft 2 and/or the rpm must be reduced for forced passage of grinding material.

As the material content per diameter interval in a grinding chamber filled to a suitable value decreases with reduced distance towards the outlet, the gradually increasing fall movement in the grinding chamber provides an evening-out effect on the material flow which, in turn, has an advantageous effect on the grinding procedure.

Naturally, the disclosed material movements apply only for the uppermost portion of the grinding chamber. A particle $Q_2$ situated in the lower portion of the plane of rotation plane $X_1$ is held there in its path, due to the angular relationship which prevails there between the force resultant $R_2$ and support (the cone casing).

Because comminution takes place between surfaces curving in the same direction, the gripping ability according to the inventive idea is very good. The comminution of particles can thus cover a very broad range instead of being divided into separate crushing and grinding steps as is common in the art.

Tests carried out with a model mill having a slightly bulbular cone casing in which the maximum diameter of the grinding chamber was 450 mm rotating at 55 rpm revealed that supplied dry pulverized crush material and sand in the dimension range of 0–2 mm at rpm 55 moved in stop-and-go fashion, generally in the path 10 (FIG. 2) toward the central outlet within the most inclined area with the following values for incline and diameter:

| Angle (FIG. 1) | | Maximum Radius (FIG. 3) |
|---|---|---|
| $V_3$ | $V_2$ | a |
| 45° | 15° | 110 mm |
| 35° | 20° | 140 mm |
| 22° | 29° | 170 mm |

What I claim is:

1. Method of influencing the degree of grinding of material fed into the peripheral portion of a rotatable grinding chamber of a mill whose inclined and upwardly diverging open bowl shaped grinding chamber has a central outlet for ground material, said mill having a rotary shaft inclined from the vertical and at least one roller cooperating with the grinding chamber, wherein the retention time of material in the grinding chamber, which corresponds to the degree of grinding, is controlled by adjusting the rpm of the grinding chamber and by adjusting the inclination of the rotary shaft, so that material in the section of the grinding chamber most inclined toward the horizontal plane slides downward toward the central outlet while being ground in accordance with the number of passes between the bowl shaped grinding chamber and the at least one roller to which the material is subjected corresponding to the desired degree of grinding.

* * * * *